US005909198A

United States Patent [19]

Mandai et al.

[11] Patent Number: 5,909,198

[45] Date of Patent: Jun. 1, 1999

[54] CHIP ANTENNA

[75] Inventors: Harufumi Mandai; Nori Nakajima, both of Takatsuki; Yoshihiro Yoshimoto, Shiga-ken, all of Japan

[73] Assignee: Murata Manufacturing Co., Ltd., Japan

[21] Appl. No.: 08/993,981

[22] Filed: Dec. 18, 1997

[30] Foreign Application Priority Data

Dec. 25, 1996 [JP] Japan ..... 8-345272

[51] Int. Cl.[6] ..... H01Q 1/24; H01Q 1/36

[52] U.S. Cl. ..... 343/895; 343/702; 343/873

[58] Field of Search ..... 343/895, 702, 343/700 MS, 873, 878, 872; H01Q 1/24, 1/36, 1/38, 1/40

[56] References Cited

U.S. PATENT DOCUMENTS 5,696,517 12/1997 Kawahata et al. ..... 343/700 MS 5,748,149 5/1998 Kawahata ..... 343/700 MS 5,767,817 6/1998 Tsuru et al. ..... 343/895

*Primary Examiner*—Hoanganh Le

*Attorney, Agent, or Firm*—Ostrolenk, Faber, Gerb & Soffen, LLP

[57] ABSTRACT

A chip antenna includes a main body and a pedestal. The main body is provided with a rectangular-parallelopiped base member with a relative dielectric constant of about 6.0 having barium oxide, aluminum oxide, and silica as main components; a conductor wound helically inside the base member in the longitudinal direction of the base member; a power-feed terminal formed on a surface of the base member, for applying a voltage to the conductor; and an open terminal formed on a surface of the base member. The pedestal is provided with a base member made from a glass epoxy resin having a relative dielectric constant of about 4.8; and external electrodes extending from opposing ends on surfaces of the base member toward adjacent side faces. The power-feed terminal and the open terminal of the main body are electrically and mechanically connected to the external electrodes of the pedestal by soldering, respectively.

18 Claims, 4 Drawing Sheets

CHIP ANTENNA

BACKGROUND OF THE INVENTION

1. Field of the Invention

The present invention relates to chip antennas, and more particularly, to a chip antenna used for mobile communications and used in local area network (LAN).

2. Description of the Related Art

As mobile communication units typical of which is a portable telephone have been made compact and lightweight, a chip antenna has been practically used as a compact antenna substitute for a large antenna such as a whip antenna or an inverted F antenna.

To mount a chip antenna on a unit stably and effectively, as shown in FIG. 7(*a*), a main body 51 is provided with a protruding section 52 at an end and a circuit board 54 on which a chip antenna 53 is mounted on the unit. The size of the unit, however, is increased by the protruding section.

To solve this problem, a rectangular circuit board 55 on which the chip antenna 53 is mounted in the vicinity of an end of the main body 51 may be used. See FIG. 7(*b*).

Since a conventional chip antenna is directly mounted on a circuit board of a unit as described above, a capacitance is generated between a conductor of the chip antenna and a ground electrode formed on the rear surface of the circuit board. With this capacitance, the gain of the chip antenna may decrease or the center frequency of the chip antenna may shift.

SUMMARY OF THE INVENTION

Accordingly, it is an object of the present invention to provide a compact chip antenna which can suppress a gain reduction and a shift of the center frequency.

The foregoing and other objects are achieved according to the present invention through the provision of a chip antenna comprising: a main body having a base member made from dielectric material or magnetic material, at least one conductor associated with said base member, and at least one power-feed terminal formed on a surface of said base member for applying a voltage to said conductor; and a pedestal for mounting said main body, the pedestal being provided with a base member, wherein the relative dielectric constant of at least a main portion of said pedestal is smaller than the relative dielectric constant of the base member of said main body.

Since the relative dielectric constant of at least the main portion of the pedestal is set smaller than that of the base member of the main body in the chip antenna, when the chip antenna is mounted on a circuit board, a pedestal having a smaller relative dielectric constant exists between the main body of the chip antenna and the circuit board. Therefore, the capacitance generated between the conductor of the main body of the chip antenna and the ground electrode formed on the rear surface of the circuit board is decreased, and a gain reduction and a shift of the center frequency in the chip antenna are suppressed.

In the above chip antenna, the pedestal may have a hole below the base member of the main body.

In this case, the hole is provided with air having a relative dielectric constant of 1. Therefore, the capacitance generated between the conductor of the main body of the chip antenna and the ground electrode formed on the rear surface of the circuit board is decreased, and a gain reduction and a shift of the center frequency in the chip antenna are suppressed.

In the above chip antenna, a gap may be provided between the main body and the pedestal.

In this case, an area having air with a relative dielectric constant of 1 is extended in the chip antenna. The capacitance generated between the conductor of the main body of the chip antenna and the ground electrode formed on the rear surface of the circuit board is decreased and a gain reduction and a shift of the center frequency in the chip antenna are suppressed.

According to a chip antenna of the present invention, since the relative dielectric constant of at least the main portion of the pedestal is set smaller than the relative dielectric constant of the base member of the main body, the capacitance generated between the conductor of the main body of the chip antenna and the ground electrode formed on the rear surface of a circuit board on which the chip antenna is mounted is decreased.

Other features and advantages of the present invention will become apparent from the following description of the invention which refers to the accompanying drawings.

BRIEF DESCRIPTION OF THE DRAWING(S)

DETAILED DESCRIPTION OF EMBODIMENTS OF THE INVENTION

Figure 1:
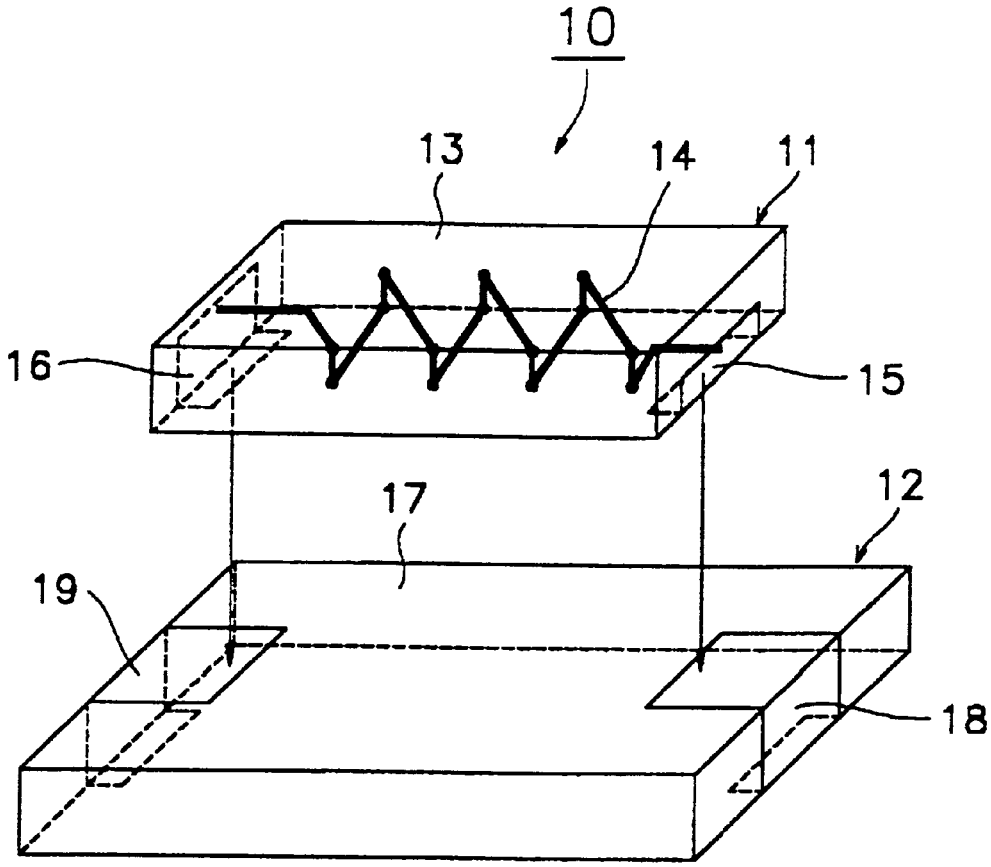
FIG. 1 is an exploded perspective view of a chip antenna according to a first embodiment of the present invention.

FIG. 1 is an exploded perspective view of a chip antenna according to a first embodiment of the present invention. A chip antenna 10 is formed of a main body 11 and a pedestal 12 for mounting the main body 11.

The main body 11 includes a rectangular-parallelopiped base member 13 with a relative dielectric constant of about 6.0 preferably having barium oxides aluminum oxide, and silica as main components, a conductor 14 wound helically inside the base member 13 in the longitudinal direction of the base member 13, and a power-feed terminal 15 for applying a voltage to the conductor 14 and an open terminal 16 formed on surfaces of the base member 13. One end of the conductor 14 is led to a surface of the base member 13 and connected to the power-feed terminal 15. The other end of the conductor 14 is led to a surface of the base member 13 and connected to the open terminal 16. The conductor 14 may be disposed inside the base member 11 by making the base member 11 of a plurality of layers, with portions of the conductor 14 being disposed on the various layers conductive through holes through the layers can be used to connect the conduction portion together when the layers are laminated together.

The pedestal 12 is provided with a base member 17 made from a glass epoxy resin having a relative dielectric constant of about 4.8 and external electrodes 18 and 19 extending from opposing ends on surfaces of the base member 17 toward adjacent side faces.

The power-feed terminal 15 and the open terminal 16 of the main body are electrically and mechanically connected to the external electrodes 18 and 19 of the pedestal 12 by soldering, respectively.

Figure 2:
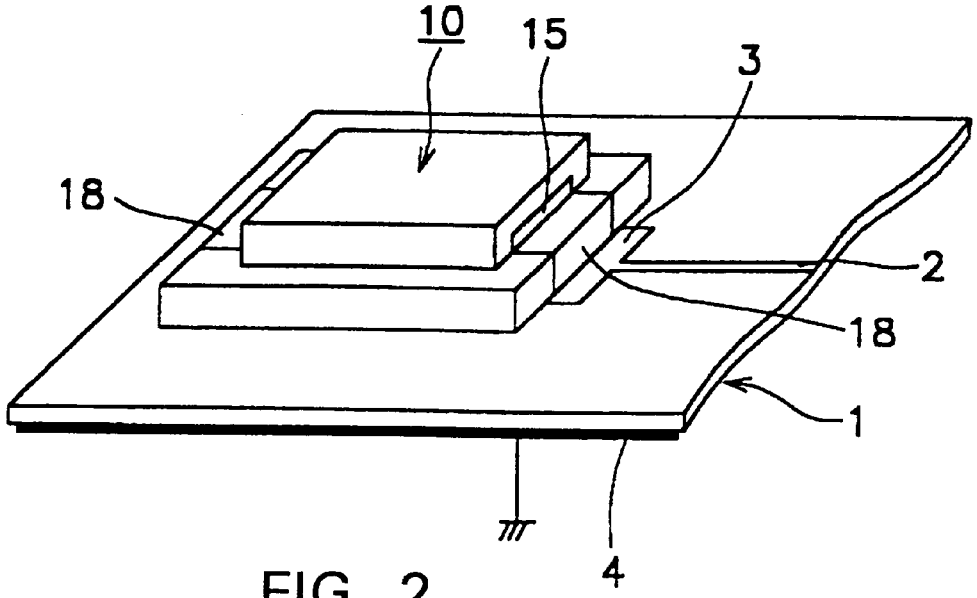
FIG. 2 is a perspective view of a the chip antenna shown in FIG. 1 mounted on a circuit board.

FIG. 2 shows a case in which the chip antenna 10 is mounted on a circuit board 1 of a unit. The circuit board 1 is made from a glass epoxy resin having a relative dielectric constant of about 4.8, and provided with a transmission line 2 and a land 3 connected to one end of the transmission line 2 on the front surface and a ground electrode 4 on the rear surface. The external electrode 18 of the pedestal 12 connected to the power-feed terminal 15 of the chip antenna 10 is connected to the land 3 on the circuit board 1. The other end of the transmission line 2 on the circuit board 1 is connected to an RF section (not shown).

Figure 3:
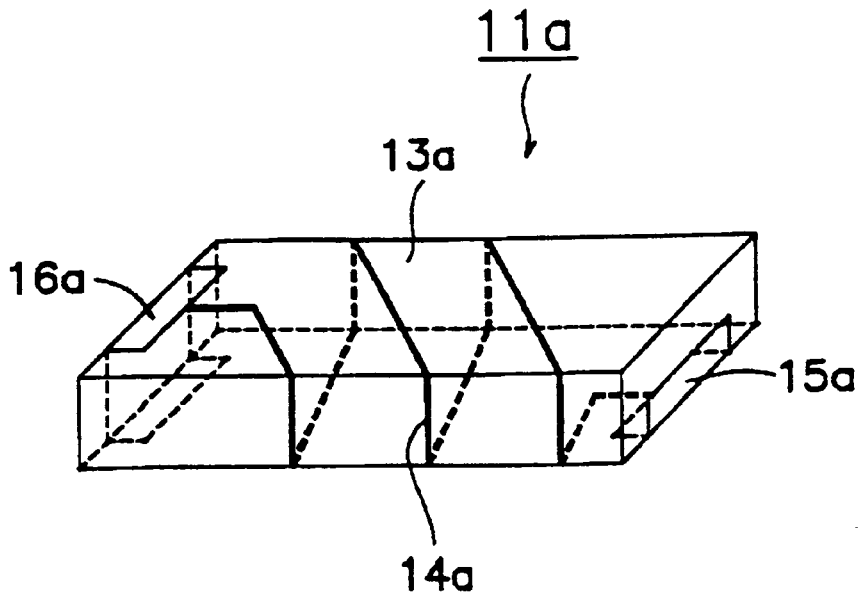
FIG. 3 is a perspective view of a modification of the main body of the chip antenna shown in FIG. 2.
Figure 4:
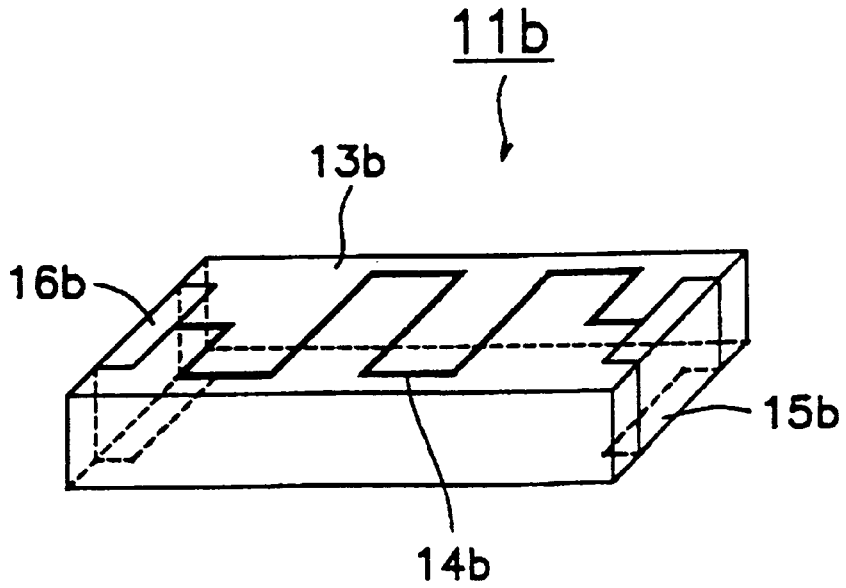
FIG. 4 is a perspective view of another modification of the main body of the chip antenna shown in FIG. 2.

FIG. 3 and FIG. 4 are perspective views of modifications of the main body 11 shown in FIG. 1. A main body 11*a* shown in FIG. 3 includes a rectangular-parallelopiped base member 13*a,* a conductor 14*a* wound helically on surfaces of the base member 13*a* in the longitudinal direction of the base member 13*a,* and a power-feed terminal 15*a* to which one end of the conductor 14*a* is connected and an open terminal 16*a* to which the other end of the conductor 14*a* is connected, both formed on surfaces of the base member 13*a*. The power-feed terminal 15*a* is used for applying a voltage to the conductor 14*a*. Since the conductor 14*a* can easily be formed helically on surfaces of the base member 13 by screen printing, a manufacturing process for the main body 11*a* is simplified.

The main body 11*b* shown in FIG. 4 includes a rectangular-parallelopiped base member 13*b,* a meander-shaped conductor 14*b* formed on a surface of the base member 13*b,* and a power-feed terminal 15*b* to which one end of the conductor 14*b* is connected and an open terminal 16*b* to which the other end of the conductor 14*b* is connected, both formed on surfaces of the base member 13*b*. The power-feed terminal 15*b* is used for applying a voltage to the conductor 14*b*. Since the meander-shaped conductor 14*b* is formed on only one main surface of the base member 13*b,* the base member 13*b* can be made to have a low profile, and thereby the main body 11*b* can be made to have a low profile. The meander-shaped conductor 14*b* may be formed inside the base member 13*b*.

According to the chip antenna of the first embodiment, since the base member of the main body has a relative dielectric constant of about 6.0 and that of the pedestal has a relative dielectric constant of about 4.8, which means that the base member of the pedestal has a smaller relative dielectric constant than the base member of the main body, a pedestal having a small relative dielectric constant exists between the main body of the chip antenna and the circuit board when the chip antenna is mounted on the circuit board.

Since the capacitance generated between the conductor in the main body of the chip antenna and the ground electrode on the rear surface of the circuit board can be made small, a gain reduction and a shift of the center frequency in the chip antenna are suppressed. When the relative dielectric constant of the base member of the main body is set to about 6.0 and that of the base member of the pedestal is set to about 4.8 as in the first embodiment, for example, the gain increases by 2 dB or more and the shift of the center frequency is reduced to a half or less.

Figure 5:
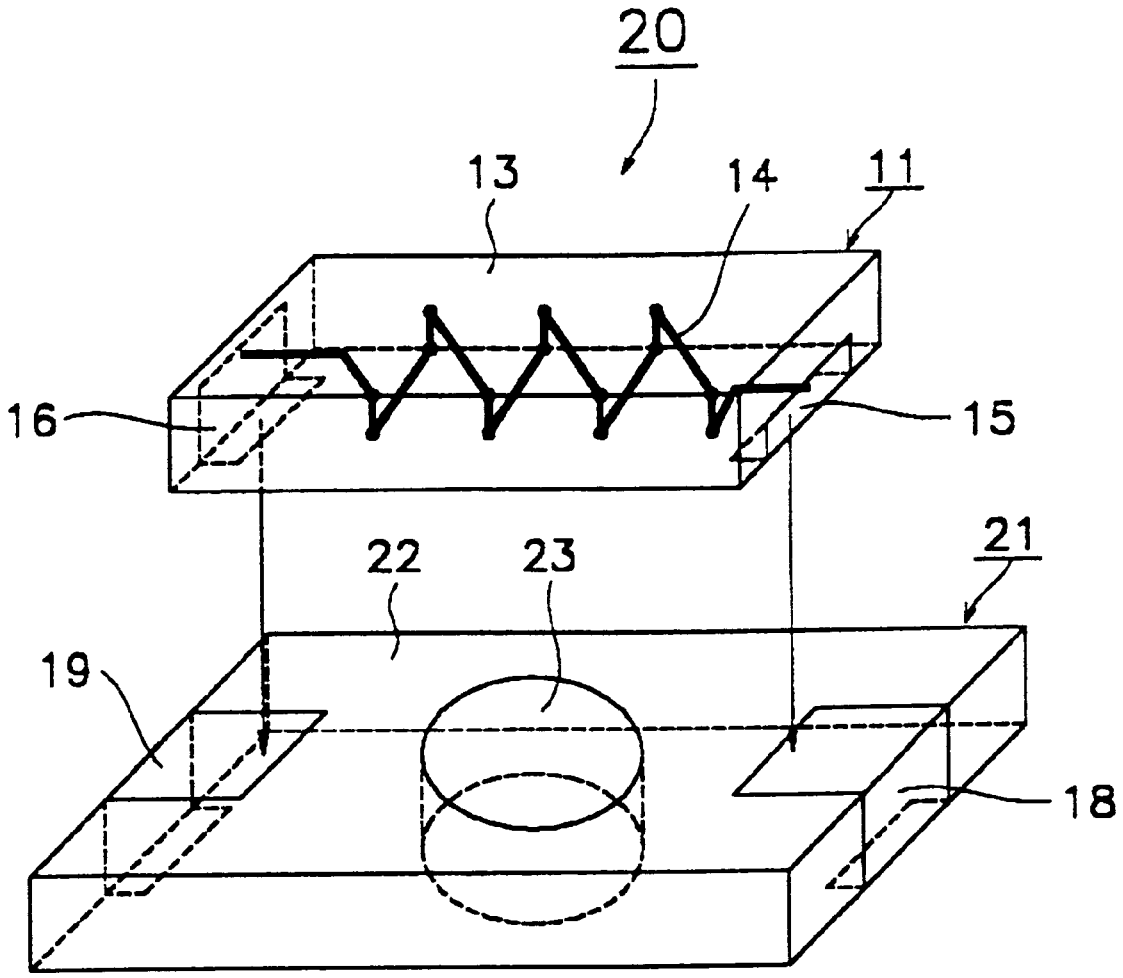
FIG. 5 is an exploded perspective view of a chip antenna according to a second embodiment of the present invention.

FIG. 5 is an exploded perspective view of a chip antenna according to a second embodiment of the present invention. A chip antenna 20 is formed of a main body 11 and a pedestal 21 for mounting the main body 11.

The main body 11 has the same structure as that shown in FIG. 1 in the first embodiment. The pedestal 21 differs from the pedestal 12 shown in FIG. 1 in the first embodiment in that a base member 22 is provided with a through hole 23.

Figure 6:
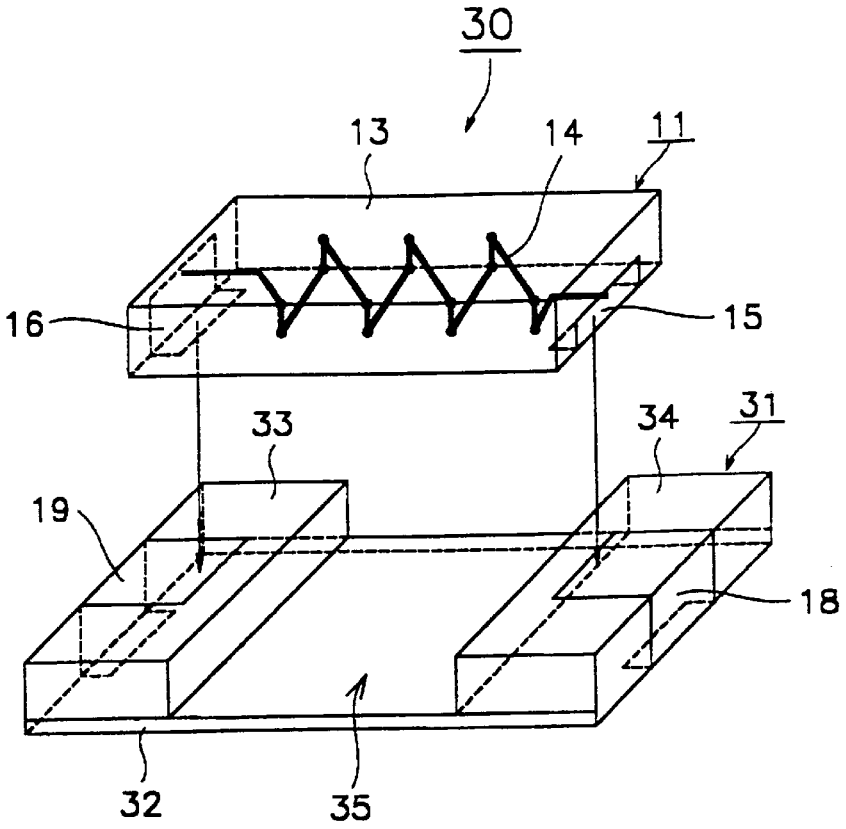
FIG. 6 is an exploded perspective view of a chip antenna according to a third embodiment of the present invention.
Figure 7A:
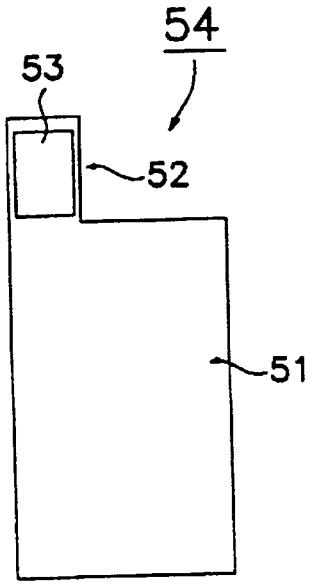
FIG. 7(*a*) is a top view of a circuit board on which a conventional chip antenna is mounted, and FIG. 7(*b*) is a top view of another circuit board on which the conventional chip antenna is mounted.
Figure 7B:
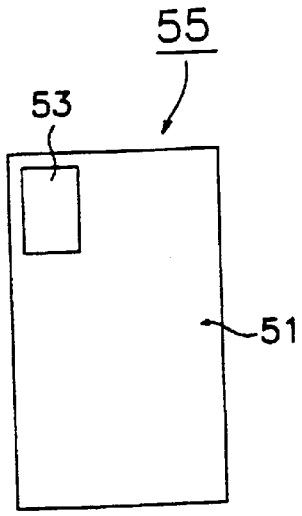

FIG. 6 is an exploded perspective view of a chip antenna according to a third embodiment of the present invention. A chip antenna 30 is formed of a main body 11 and a pedestal 31 for mounting the main body 11.

The main body 11 has the same structure as that shown in FIG. 1 in the first embodiment. The pedestal 31 differs from the pedestal 12 shown in FIG. 1 in the first embodiment in that protruding sections 33 and 34 are formed at opposing ends of a base member 32 to provide a gap 35 between the main body 11 and the pedestal 31 when the main body 11 is mounted on the pedestal 31.

According to the chip antennas of the second and the third embodiments, since the pedestal is provided with a hole or a gap is provided between the main body and the pedestal, the capacitance generated between the conductor in the main body of the chip antenna and the ground electrode on the rear surface of the circuit board can be made further small. In other words, since air exists in the through hole and the gap, the relative dielectric constant in the through hole and the gap is 1. Therefore, the capacitance generated between the conductor in the main body of the chip antenna and the ground electrode on the rear surface of the circuit board becomes further small, and a gain reduction and a shift of the center frequency in the chip antenna are more suppressed. Especially with the gap, because an area filled with air can be made further large, a gain reduction and a shift of the center frequency in the chip antenna are more suppressed.

In the above embodiments, the base member of the main body is preferably made from a dielectric material having barium oxide, aluminum oxide, and silica as main components. The material of the base member is not limited to this dielectric material. A material (relative dielectric constant: about 37) having titanium oxide and neodymium oxide as main components, a magnetic material (relative dielectric constant: about 10) having nickel, cobalt, and iron as main components, and a combination of a dielectric material and a magnetic material may be used.

In the above embodiments, the base member of the pedestal is made from a glass epoxy resin. Any material having a smaller relative dielectric constant than the base member of the main body may be used, such as a fluororesin (relative dielectric constant: about 2.2) and a polyamide (relative dielectric constant: about 3.8).

In the above embodiments, one conductor is used in the main body. A plurality of conductors disposed in parallel may be used. In this case, the chip antenna has a plurality of resonant frequencies according to the number of conductors used, and the antenna can handle multiple bands.

In the above embodiments, one main body is mounted on one pedestal. A plurality of main bodies may be mounted on one pedestal.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A chip antenna comprising:

a main body having a base member made from at least one of a dielectric material and a magnetic material, at least one conductor associated with said base member, and at least one power-feed terminal formed on a surface of said base member for applying a voltage to said conductor; and a pedestal for mounting said main body, the pedestal being provided with a pedestal base member, wherein the relative dielectric constant of at least a main portion of said pedestal is smaller than the relative dielectric constant of the base member of said main body.

2. The chip antenna of claim 1, wherein said pedestal has a hole below the base member of said main body.

3. The chip antenna of claim 2, wherein a gap is provided between said main body and said pedestal.

4. The chip antenna of claim 2, wherein the conductor has a meander shape.

5. The chip antenna of claim 2, wherein the hole comprises an air gap.

6. The chip antenna of claim 1, wherein a gap is provided between said main body and said pedestal.

7. The chip antenna of claim 6, wherein the gap is provided by at least one protrusion extending from the pedestal base member toward the main body holding the main body at a distance from the pedestal base member.

8. The chip antenna of claim 6, wherein the gap comprises an air gap.

9. The chip antenna of claim 1, wherein the conductor is disposed inside the base member.

10. The chip antenna of claim 1, wherein the conductor is disposed on a surface of the base member.

11. The chip antenna of claim 1, wherein the pedestal is mounted on a circuit board.

12. The chip antenna of claim 1 wherein the conductor is spirally arranged.

13. The chip antenna of claim 1, further comprising a further electrical terminal on a surface of said base member to which a free end of the conductor is connected.

14. The chip antenna of claim 1, wherein the base member is soldered to the pedestal through said power feed terminal.

15. The chip antenna of claim 1, wherein the pedestal has at least one electrical connection for connecting to said power feed terminal.

16. The chip antenna of claim 1, wherein the pedestal has two electrical connections for electrically connecting to said base member and for securing the base member to the pedestal.

17. The chip antenna of claim 1, wherein the base member is a rectangular parallelopiped.

18. The chip antenna of claim 17, wherein the pedestal is a rectangular parallelopiped.

* * * * *